US007628628B2

(12) United States Patent
Matsuda et al.

(10) Patent No.: US 7,628,628 B2
(45) Date of Patent: Dec. 8, 2009

(54) CONNECTOR HAVING FLOATING STRUCTURE

(75) Inventors: Takeshi Matsuda, Tokyo (JP); Masaji Komuro, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/269,139

(22) Filed: Nov. 12, 2008

(65) Prior Publication Data

US 2009/0264008 A1 Oct. 22, 2009

(30) Foreign Application Priority Data

Apr. 18, 2008 (JP) ..... 2008-108874

(51) Int. Cl.
*H01R 13/64* (2006.01)

(52) U.S. Cl. ..... 439/248; 439/247

(58) Field of Classification Search ..... 439/247–248, 439/460, 246, 378

See application file for complete search history.

(56) References Cited

U.S. PATENT DOCUMENTS 3,094,364 A * 6/1963 Liagg ..... 439/247
3,611,266 A * 10/1971 Amis et al. ..... 439/550
4,580,862 A * 4/1986 Johnson ..... 439/248
5,167,520 A * 12/1992 Henry et al. ..... 439/266
5,746,617 A * 5/1998 Porter et al. ..... 439/248
6,344,736 B1 * 2/2002 Kerrigan et al. ..... 324/158.1
6,390,841 B1 * 5/2002 Zaguskin ..... 439/248
7,090,521 B2 * 8/2006 Nishio et al. ..... 439/248

FOREIGN PATENT DOCUMENTS

JP 2005-129453 A 5/2005
JP 2005-129454 A 5/2005

* cited by examiner

*Primary Examiner*—Michael C Zarroli
(74) *Attorney, Agent, or Firm*—Darby & Darby, P.C.

(57) ABSTRACT

A connector assembly having a floating structure includes a connector moveably mounted in a cradle housing. A part of this connector connects to and detaches from another connector facing, through a spacing, a connector-mounting window of the cradle housing. The connector on the moveable side is moveable freely within the range of the spacing. An elastic member of flexible material is provided on the exterior of the moveable-side connector and closely contacts and is housed in a housing part formed in the cradle housing. An elastic member restoring force, acting when coupling between the moveable-side connector and the other connector is released, causes the moveable-side connector to return its original position in the cradle housing.

6 Claims, 4 Drawing Sheets

CONNECTOR HAVING FLOATING STRUCTURE

CROSS-REFERENCE TO RELATED APPLICATION

This application claims the benefit under 35 U.S.C. § 119 of Japanese Patent Application No. 2008-108874, filed on Apr. 18, 2008, which is hereby incorporated by reference herein in its entirety.

FIELD OF THE INVENTION

The present invention relates to a connector having a floating structure such that when a connector provided on a digital camera, cell phone, digital video camera or other electronic device is coupled to a connector provided on the cradle of a charging device or the like, one connector is provided with freedom to move forwards, backwards, left and right, and positional displacement of the coupling between connectors is absorbed.

BACKGROUND OF THE INVENTION

In the case where digital cameras, cell phones, digital video cameras and other electronic devices transmit and receive information or recharge while in an interconnected state with plugs or multi-pin connectors, if the plug or multi-pin connectors are rigidly attached to the device there is a risk that the connectors may become damaged due to twisting when mated together. As a countermeasure, a slight spacing, in the width-direction of the electronic device, and a so-called floating structure preventing too-heavy a load from being applied on the connector and attached such that the connector of the charger or the like can move freely within a certain range are provided in the concave portion of the charger or the like that mates with the electronic device.

Examples of connectors having this type of floating structure are as shown in FIG. 6 (Japanese Unexamined Patent Application Publication No. 2005-129454) and FIG. 7 (Japanese Unexamined Patent Application Publication No. 2005-129453).

FIG. 6, which illustrates the Patent Reference Document 1, is a plan view showing the state wherein a connector attached to a movable printed circuit board 17 in a charger or the like is fitted loosely, via a spacing 16, in a connector-mounting window 15 of a connector housing 14. On either side of the connector housing 14 are provided two S-shaped elastic members 19 that have been bent into the shape of the letter S. These S-shaped elastic members 19 are integrally molded with the same material as the connector housing 14, provided with uniform elasticity in all horizontal directions, and are configured so as to have a return force that returns to the center position if deformed. On the exterior sides of the S-shaped elastic members 19 are provided an integrated securing part 20, and this securing part 20 is secured to the housing on the cradle. Moreover, a downward-facing circular boss 23 is provided on the cradle housing, and this boss 23 is fitted loosely to a cylindrical part 21 of the connector housing 14 via a spacing 26. Additionally, reference numeral 18 denotes a flexible cable.

With a configuration as described above, the boss 23 in the cradle housing is fitted loosely to the cylindrical part 21 of the connector housing 14 due to the spacing 26 around the entire periphery, and moreover, because the spacing 16 is provided between a connector 11 and the connector-mounting window 15, the connector 11, the connector housing 14 and the entire moveable printed circuit board 17 provided on the bottom side thereof constitute a floating structure that moves freely within the range of the spacing 26. Additionally, although the connector housing 14 is secured to the cradle housing at the securing parts 20 on both sides, the S-shaped elastic members 19 provided at four locations are formed to provide elasticity, and the connector 11 is able to move forwards, backwards, left, right, and diagonally in any arbitrary horizontal direction to couple with another connector. When the device-side connector is pulled out from the connector on the charger side or the like, a restoring force due to deformation of the S-shaped elastic members 19 acts to return the connector housing 14 that is integrated with the connector 11 to a center position.

In FIG. 7, which illustrates the Patent Reference Document 2, a connector-mounting window 15 is provided on a cradle housing 22, and a circular boss 23 is provided on both sides of the connector-mounting window 15. A connector housing 14 that protects a connector 11 is separated from the connector-mounting window 15 by a spacing 16 and is loosely fitted to the interior side of the connector-mounting window 15. The connector 11 is attached to a moveable printed circuit board 17, and the moveable printed circuit board 17 is attached to the bottom side of the connector housing 14. Moreover, a cylindrical part 21 having a large inner diameter is provided with a spacing 26 such that the boss 23 is loosely fitted, and the cylindrical part 21 is configured with a lower height than that of the boss 23. Then, in the state where the cylindrical part 21 is loosely fitted in the outer periphery of the boss 23 due to the spacing 26, a sliding washer 24 having a diameter larger than the inner diameter of the cylindrical part 21 is secured to the boss 23 by a screw 25.

A coil spring elastic member 19 is fitted between the lower face of the cradle 22 on the exterior of the boss 23 and the upper face of the connector housing 14 so that the connector housing 14 slides in all directions and returns to a center position.

In a configuration as described above, since the cylindrical part 21 of the connector housing 14 is mounted, via the spacing 26, along the entire periphery of the boss 23 in the cradle housing 22 and the spacing 16 is provided between the connection 11 and the connector-mounting window 15, the connector 11, the connector housing 14 and the entire moveable printed circuit board 17 provided on the bottom side thereof constitute a floating structure that moves freely in all directions within the range of the spacing 26, and always returns to a center position even when moved in a horizontal direction due to the action of the return force enabled by the provision of at least two coil spring elastic members 19.

Besides this type of floating structure, additionally, as shown in FIG. 5, the provision of a tapered face 13 on the upper inner side of a cradle connector 11 (so-called female connector) and a tapered face 12 on the lower outer side of a digital camera-side connector 10 (so-called male connector), enable the tapered faces to make contact with each other in response to a positional displacement, and to guide and move the floating structure connector 11 and the moveable printed circuit board 17 so that the displacement can be absorbed as long as the displacement is within the range of contact of the tapered faces 12 and 13 (range L indicated by arrows in FIG. 5).

The following types of problems existed in connectors having a conventional floating structure.

(1) The structure shown in FIG. 6 enables, with no increase in the part count, the provision of a connector wherein two S-shaped elastic members 19 are provided on each of the left and right sides of the connector housing 14, a downward-facing circular boss 23 is provided on the cradle-side housing, and the boss 23 is loosely fitted via the spacing 26 to the cylindrical part 21 of the connector housing 14, and whereby as a result, the connector deforms in all horizontal directions, has a restoring force and has a centering structure that returns to a center position when the coupling between connectors is released. However, the rather complex structures of the four S-shaped elastic members 19, the downward-facing boss 23, and the cylindrical part 21 of the connector housing 14 and so on present some problems for miniaturization.

(2) The structure shown in FIG. 7 enables the provision of connector wherein the spacing formed in the connector-mounting window of the cradle housing is significantly smaller than the conventional spacing, the maximum displacement between the connectors is supported, and the connector moves freely in all directions to absorb error when coupled and has a centering structure that returns to a center position when the coupling is released, moreover the coil spring elastic member is well suited for the case where leeway exists in the widthwise but not in the heightwise direction. However, the rather complex structure and large number of component parts and present some problems for assembly and miniaturization.

(3) The structure shown in FIG. 5 is simple and can be miniaturized, but has the problems of only being capable of handling displacement over the range of the tapered faces and of being unable to return to the original position when the connectors are unplugged.

An object of the present invention is to provide a connector having a simple structure and low part count, that is easy to assemble, and has a floating structure that can be miniaturized.

SUMMARY OF THE INVENTION

A connector having a floating structure according to the present invention in the case where both the electronic device-side and cradle-side have a connector, wherein the connector having a floating structure includes:

a connector moveably mounted in a cradle housing, a part of this connector that connects to and detaches from another connector facing, through a spacing, a connector-mounting window of the cradle housing, and the connector on the moveable side being moveable freely within the range of the spacing; wherein an elastic member of flexible material is provided on the exterior of the moveable-side connector, the connector provided with this elastic member closely contacts and is housed in a housing part formed in the cradle housing, and an elastic member restoring force, acting when coupling between the moveable-side connector and another connector is released, causes the moveable-side connector to return to the original position of the connector.

The elastic member may be formed by a secondary molding using flexible material that has elasticity on the exterior of the connector housing comprising the moveable-side connector.

Moreover, on the exterior of the connector housing comprising the moveable-side connector, the elastic member may be formed by a secondary molding using flexible material that has elasticity such that the exterior surface has a plurality of protrusions, and the moveable-side connector is housed such that the protrusions are in close contact with the interior of the housing part.

In the case where the electronic device-side and the cradle-side each have two connectors separated by a certain distance, one connector may be moveably mounted on the cradle housing and the other connector fixedly mounted on the cradle housing.

Moreover, in the case where the electronic device-side and the cradle-side each have two connectors separated by a certain distance, two connectors may be moveably mounted on the cradle housing. In this case, the moving distance of the two connectors due to the elastic member is set to a smaller value on the side that first contacts the other connector and to a larger value on the side that subsequently contacts the other connector.

The elastic member of flexible material may be provided on the exterior of the moveable-side connector, the connector provided with this elastic member closely contacts and is housed in a housing part formed in the cradle housing, and an elastic member restoring force, acting when coupling between the moveable-side connector and another connector is released, causes the moveable-side connector to return to the original position of the connector, enables the provision of a connector having a floating structure and also having a simple structure, a low part count, being easy to assemble and capable of being miniaturized.

On the exterior of the connector housing comprising the moveable-side connector, the elastic member may be formed by the secondary molding using flexible material that has elasticity, thereby enabling the elastic member to be configured easily with secondary molding using flexible material having elasticity on the connector housing of the primary molding.

On the exterior of the connector housing comprising the moveable-side connector, the elastic member may be formed by secondary molding using flexible material that has elasticity such that the exterior surface has a plurality of protrusions, and the moveable-side connector is housed such that the protrusions are in close contact with the interior of the housing part, enables the amount of movement to be adjusted easily according to the size of the protrusions.

In another embodiment of the present invention, the connector having a floating structure may include two connectors separated by a certain distance and mounted in a cradle housing, at least one of the connectors being moveably mounted in the cradle housing, a part of the moveably mounted connector that connects to and detaches from another connector faces, through a spacing, a connector-mounting window of the cradle housing, and the moveably mounted connector being moveable freely within the range of the spacing; wherein an elastic member of flexible material is provided on the exterior of the moveably mounted connector. The connector provided with this elastic member closely contacts and is housed in a housing part formed on the cradle housing, and an elastic member restoring force, acting when coupling between the moveably mounted connector and another connector is released, causes the moveably mounted connector to return to the original position of the connector, thereby enabling reliable mating and connecting even in the case where there are two connectors separated by a certain distance on both the electronic device-side and the cradle-side and at least one of the connectors moves.

In the connector having a floating structure with two connectors separated by a certain distance, the two connectors may be moveably mounted in a cradle housing, parts of the moveably mounted connectors that connect to and detach from another connector face, through a spacing, a respective connector-mounting window of the cradle housing, and the two moveably mounted connectors may move freely within the range of the spacing. An elastic member of flexible material is provided on the exterior of each moveably mounted connector. Each connector provided with this elastic member closely contacts and is housed in a respective housing part formed on the cradle housing, and an elastic member restoring force, acting when coupling between the moveably mounted connectors and other connectors is released, causes the two moveably mounted connectors to return to the original position of the connectors, thereby enabling reliable mating and connecting even in the case where there are two connectors separated by a certain distance on both the electronic device-side and the cradle-side and both of the connectors move.

In the connector having a floating structure with two movably mounted connectors, the moving distances according to the elastic members in the two moveably mounted connectors may be set to a smaller value for the side that first touches another connector and to a larger value for the side that subsequently touches the other connector, thereby enabling reliable mating and connecting even in the case where the two connectors have different contact heights.

BRIEF DESCRIPTION OF THE DRAWINGS

The invention will become more readily apparent from the Detailed Description of the Invention, which proceeds with reference to the drawings in which:

FIG. 3(*b*) provides a transverse sectional view showing an example of protrusions provided on the outer peripheral surface of the elastic material of the cradle-side connector for closely contacting an inner surface of a housing part of the cradle housing.

FIG. 3(*c*) provides the transverse sectional view of FIG. 3(*a*), in a state where the elastic member is deformed to move the cradle-side connector away from an uncoupled position, thereby generating a restoring force in the elastic member.

FIG. 3(*d*) provides the transverse sectional view of FIG. 3(*b*), in a state where the elastic member is deformed to move the cradle-side connector away from an uncoupled position, thereby generating a restoring force in the elastic member.

DETAILED DISCLOSURE OF THE INVENTION

Figure 1:
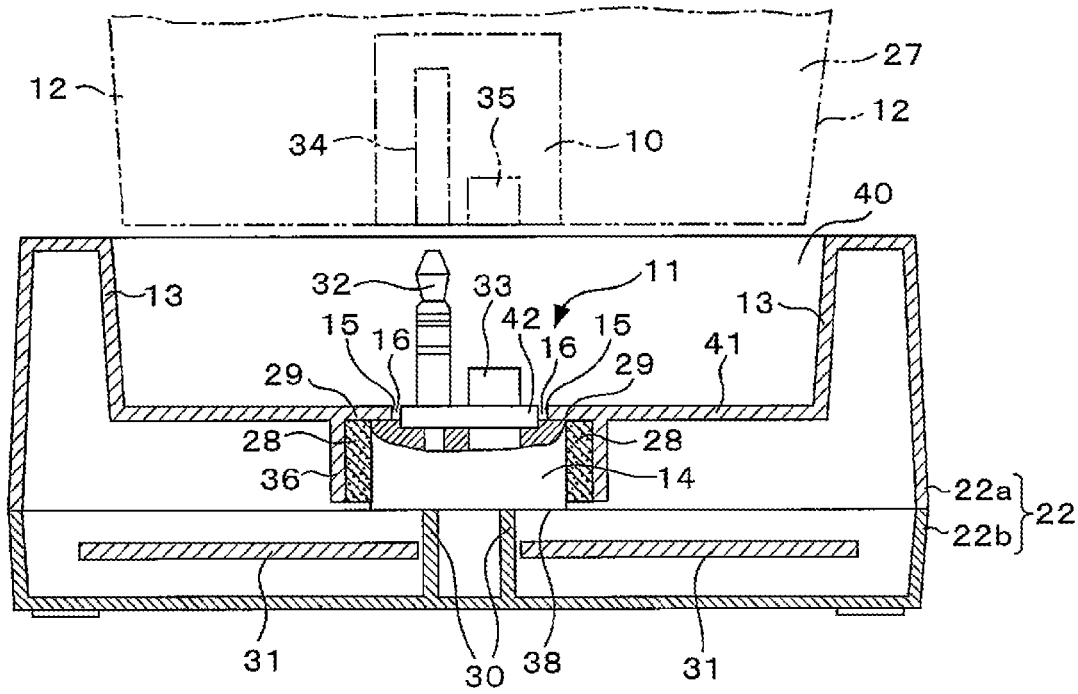
FIG. 1 provides a longitudinal sectional view showing a first embodiment of a connector having a floating structure according to the present invention.

The following listing identifies a number of elements of the embodiments of the present invention described herein and associated reference numerals used in the drawings.

| | |
|---|---|
| 10 | electronic device-side connector |
| 11 | cradle-side connector |
| 12 | tapered face |
| 13 | tapered face |
| 14 | connector housing |
| 15 | connector mounting-use window |
| 16 | spacing |
| 17 | moveable printed circuit board |
| 18 | flexible cable |
| 19 | elastic part |
| 20 | fixed part |
| 21 | cylindrical part |
| 22 | cradle housing |
| 22(a) | upper casing |
| 22(b) | lower casing |
| 23 | boss |
| 26 | screw |
| 26 | spacing |
| 27 | electronic device |
| 28 | elastic material |
| 29 | flange |
| 30 | platform |
| 31 | printed circuit board |
| 32 | pin plug |
| 33 | multipole socket |
| 34 | pin socket |
| 35 | multipole plug |
| 36 | housing part |
| 37 | top face part |
| 38 | bottom face part |
| 39 | protrusion |
| 40 | concave mating part |
| 41 | inside bottom portion |
| 42 | attachment base. |

In the case of having one connector each of the electronic device-side and on the cradle-side, the connector having a floating structure according to the present invention comprises a connector moveably mounted in a cradle housing, a part of this connector that connects to and detaches from another connector faces, through a spacing, a connector-mounting window of the cradle housing, and the connector on the moveable side being moveable freely within the range of the spacing. An elastic member of flexible material is provided on the exterior of the moveable-side connector. The connector provided with this elastic member closely contacts and is housed in a housing part formed in the cradle housing, and an elastic member restoring force, acting when coupling between the moveable-side connector and another connector is released, causes the moveable-side connector to return to the original position of the connector.

The elastic member is formed on the exterior of the connector housing comprising the moveable-side connector by a secondary molding using flexible material that has elasticity.

Moreover, on the exterior of the connector housing comprising the moveable-side connector, the elastic member is formed by a secondary molding using flexible material having elasticity such that the exterior surface has a plurality of protrusions, and the moveable-side connector is housed such that the protrusions are in close contact with the interior of the housing part.

In the case where both the electronic device-side and the cradle-side have two connectors separated by certain distance, and at least one of the connectors moves, a configuration according to the present invention may be as follows.

In a connector having a floating structure configured such that at least one of two connectors separated by a certain distance and being mounted in a cradle housing is moveably mounted in the cradle housing, a part of the moveably mounted connector that connects to and detaches from another connector faces, through a spacing, a connector-mounting window of the cradle housing, and the moveably mounted connector is moveable freely within the range of the spacing. An elastic member of flexible material is provided on the exterior of the moveably mounted connector. The connector provided with this elastic member closely contacts and is housed in a housing part formed on the cradle housing, and an elastic member restoring force, acting when coupling between the moveably mounted connector and another connector is released, causes the moveably mounted connector to return to the original position of the connector.

In the case where both the electronic device-side and the cradle-side have two connectors separated by certain distance, and both of the connectors move, a configuration according to the present invention may be as follows.

In a connector having a floating structure configured such that two connectors are separated by a certain distance and are moveably mounted in a cradle housing, parts of the moveably mounted connectors that connect to and detach from another connector face, through a spacing, respective connector-mounting windows of the cradle housing, and the two moveably mounted connectors are moveable freely within the range of the spacing. An elastic member of flexible material is provided on the exterior of each moveably mounted connector. Each connector provided with this elastic member closely contacts and is housed in a respective housing part formed on the cradle housing, and an elastic member restoring force, acting when coupling between the moveably mounted connectors and other connectors is released, causes the two moveably mounted connectors to return to the original position of the connectors.

In this case, the moving distances according to the elastic members in the two moveably mounted connectors may be set to a smaller value for the side that first touches another connector and to a larger value for the side that subsequently touches the other connector.

Several embodiments of the present invention are now described by way of example to further illustrate features of the invention.

Embodiment 1

Figure 2:
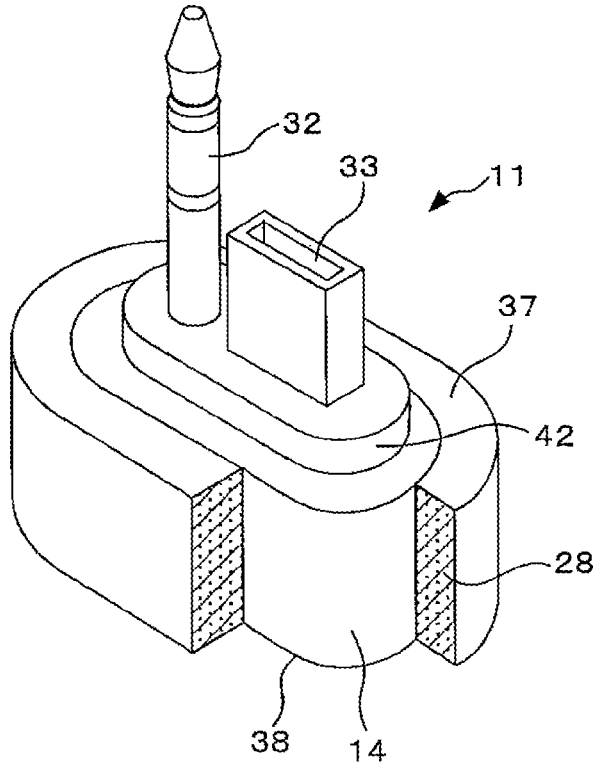
FIG. 2 provides an oblique view, partially broken away, showing an embodiment of a cradle-side connector according to the present invention.
Figure 3A:
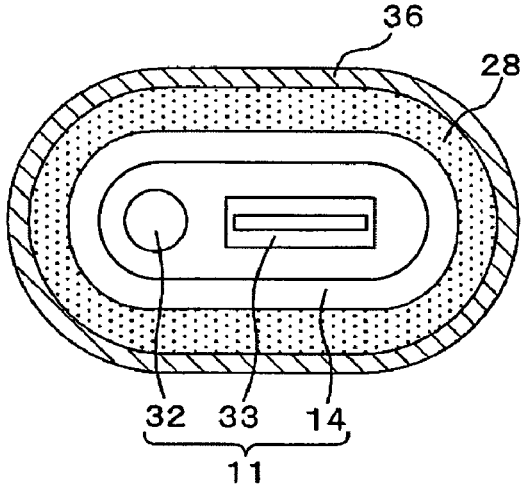
FIG. 3(*a*) provides a transverse sectional view showing an example of the entire outer peripheral surface of an elastic material of the cradle-side connector closely contacting and mating with an inner peripheral surface of a housing part of the cradle housing.
Figure 3B:
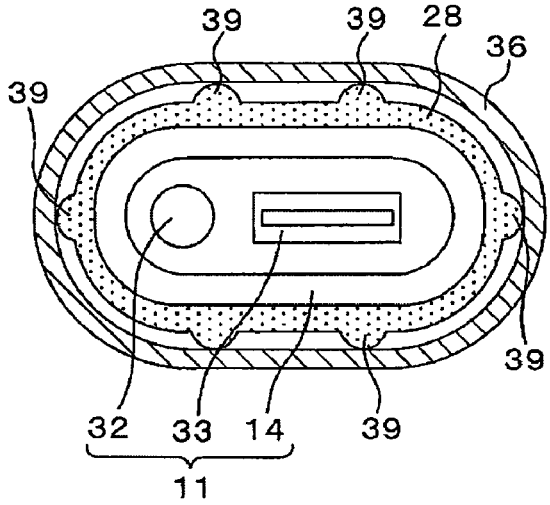

In FIG. 2, reference numeral 11 denotes a cradle-side connector of the present invention, and this cradle-side connector 11 includes an attachment base 42 integrally formed with a pin plug 32 and a multipole socket 33. The cradle-side connector also includes structure comprising a lead wire (not shown) that preferably is integrally formed by primary molding of a connector housing 14, and the outer periphery of the connector housing 14 is covered by an elastic material 28 of rubber or the like that is flexible and elastic, and which is preferably formed by secondary molding.

More specifically, the structure including of the pin plug 32, the multipole socket 33, the lead wire and so on integrally formed with the attachment base 42 is covered by a primary molding of the connector housing 14 that is preferably made of hard plastic or the like so that a stepped part of the top face of the attachment base 42 protrudes slightly therethrough. Excluding a top face part 37 and a bottom face part 38, the sidewall portions of the connector housing 14 are covered with the elastic material 28 of rubber or the like that is flexible, elastic and has a certain thickness formed by a secondary molding.

The elastic material 28 is formed to a thickness selected such that application of a load due to twisting when an electronic device connector and a connector of a charger or the like are mated together does not damage the connectors. The connectors are able to move freely to a certain extent, and after the connectors are pulled apart, a returning force acts to return the connector to its center position.

In FIG. 1, reference numeral 22 denotes a cradle housing comprising an upper casing 22*a* and a lower casing 22*b*. On the top face of the upper casing 22*a* is provided a concave mating part 40 that mates with an electronic device 27. Formed on an inner sidewall portion of the concave mating part 40 is a tapered face 13 that becomes narrower in the downward direction, and provided on the lower face of an inside bottom portion 41 of the concave mating part 40 is a housing part 36 that closely contacts and houses the elastic material 28 of the cradle-side connector 11. At approximately the center of the inside bottom portion 41 that is surrounded by the housing part 36 is formed a connector mounting-use window 15, protruding from the connector mounting-use window 15 are the pin plug 32 and the multipole socket 33 on the cradle-side connector 11 and also the stepped part of the attachment base 42 via a spacing 16 such that the connector can move freely to a certain extent within the entire periphery, and the top face part 37 of the connector housing 14 closely contacts a lower face of a flange 29 that configures the connector mounting-use window 15. Reference numeral 31 denotes a printed circuit board.

On a lower face of the electronic device 27 inserted into and connected to the cradle housing 22 is provided an electronic device-side connector 10 comprised of a pin socket 34 and a multipole plug 35 that connect to the pin plug 32 and the multipole socket 33 of the cradle-side connector 11. Moreover, a tapered face 12 for mating to the tapered face 13 of the concave mating part 40 is formed on a sidewall of the electronic device 27.

When the cradle-side connector 11 configured as above is inserted into the housing part 36 from the bottom side of the upper casing 22*a*, as shown in FIG. 3(*a*), the outer peripheral surface of the elastic material 28 closely contacts the inner peripheral surface of the housing part 36, the pin plug 32 and the multipole socket 33 protrude upwards, the attachment base 42 is fitted loosely with the spacing 16 disposed between the connection mounting-use window 15 and the attachment base 42, and the upper face part 37 of the connector housing 14 closely contacts the lower face of the flange 29. When lead wires or the like for the pin plug 32 and the multipole socket 33 are connected to the printed circuit board 31 and the lower casing 22*b* is inserted into the upper casing 22*a*, the bottom face part 38 of the cradle-side connector 11 is placed on a platform 30 so as to allow free movement in the horizontal direction.

In the above type of configuration, so as to mate and connect the device-side connector 10 of the electronic device 27 to the cradle-side connector 11 of the cradle housing 22, inserting the electronic device 27 into the concave mating part 40 causes the tapered face 12 of the electronic device 27 to be guided by the tapered face 13 of the concave mating part 40 and inserted. At this time, a positional displacement exists between the pin socket 34 of the electronic device-side connector 10 and the pin plug 32 of the cradle-side connector 11, and both connectors twist while attempting to mate together. When the force from this twisting acts on the cradle-side connector 11, the elastic material 28 is compressed in the direction of this force and moves horizontally within the range of the spacing 16. At this time, the connector housing 14 is placed on the platform 30, and while prevented from being pressed downward the cradle-side connector 11 moves horizontally. When the electronic device 27 is inserted farther into the concave mating part 40, the multipole plug 35 of the electronic device-side connector 10 and the multipole socket 33 of the cradle-side connector 11 become connected.

After charging or the like is completed and the electronic device 27 is pulled out from the cradle housing 22, the top face part 37 of the cradle-side connector 11 is held by the lower face of the flange 29, and the electronic device-side connector 10 can be removed from the cradle-side connector 11. When the electronic device-side connector 10 is removed from the cradle-side connector 11, even if the cradle-side connector 11 moves horizontally due to twisting, the restoring force of the elastic material 28 returns the cradle-side connector 11 to its original position.

In the example of FIG. 3(*a*), the entire outer peripheral surface of the elastic material 28 closely contacts the entire inner peripheral surface of the housing part 36, but without this restriction, as shown in FIG. 3(*b*), a configuration may also alternatively be used in which a plurality of protrusions 39 formed on the outer peripheral surface of the elastic material 28 closely contact the inner peripheral surface of the housing part 36. With such a configuration, movement is possible even with a small twisting force, and the moving distance can be increased. Moreover, the moving distance can be adjusted easily.

In FIG. 3(*c*), the assembly of FIG. 3(*a*) is shown after the cradle-side connector 11 has been displaced by a moving distance 28'. An elastic member returning or restoring force R (illustrated by arrows) is generated in the elastic material 28, which upon a decoupling of the electronic device-side connector 10 from the cradle-side connector 11, acts as described above to return the cradle-side connector 11 to its original position as shown in FIG. 3(*a*).

In FIG. 3(*d*), the assembly of FIG. 3(*b*) is shown after the cradle-side connector 11 has been displaced by a moving distance 28". Like the assembly of FIG. 3(*c*), FIG. 3(*d*) shows elastic member returning or restoring force R (illustrated by arrows) as generated in the elastic material 28, which upon a decoupling of the electronic device-side connector 10 from the cradle-side connector 11, acts as described above to return the cradle-side connector 11 to its original position as shown in FIG. 3(*b*).

Embodiment 2

Figure 4:
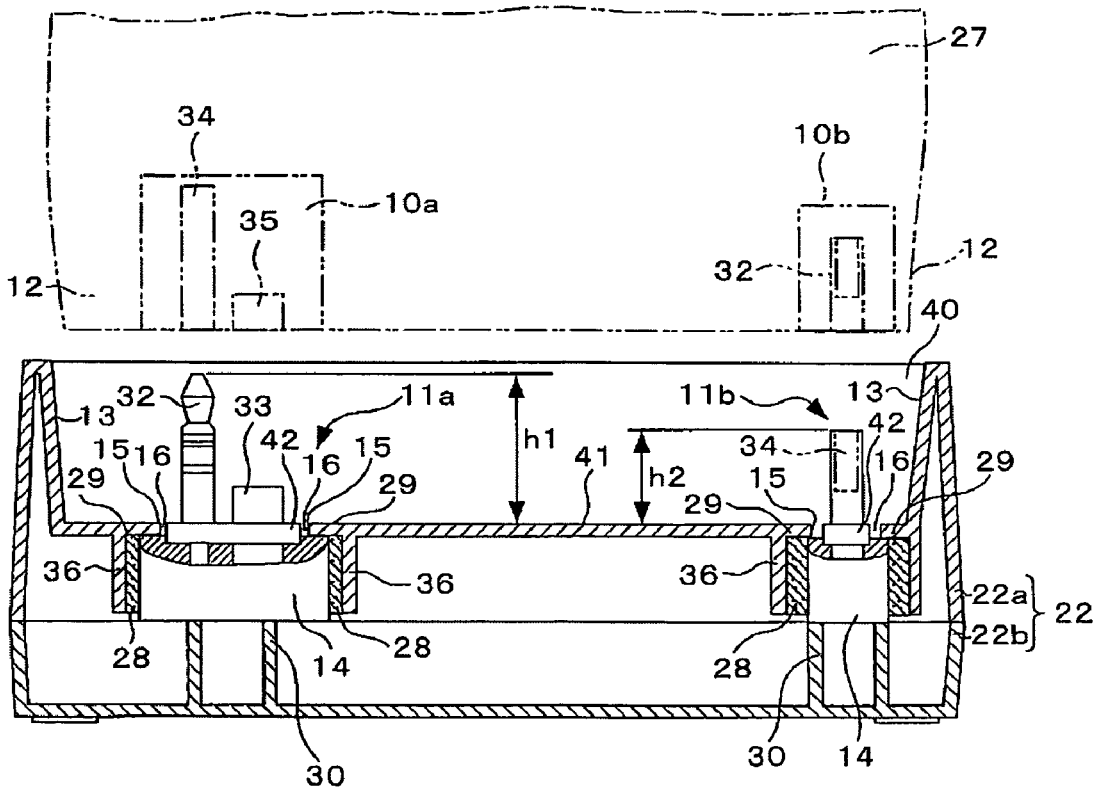
FIG. 4 provides a longitudinal sectional view showing a second embodiment of a connector having a floating structure according to the present invention.
Figure 3C:
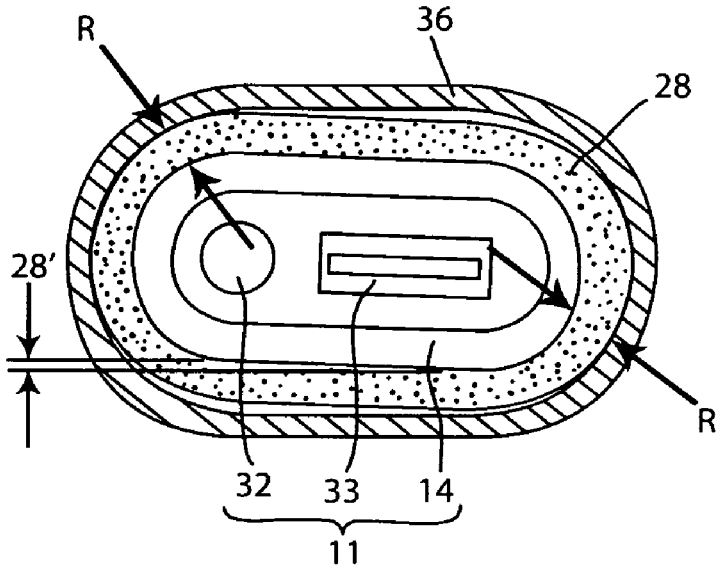
Figure 3D:
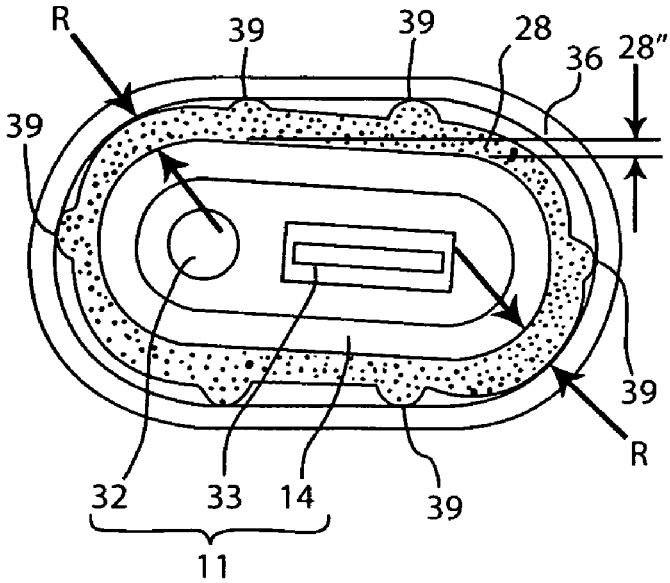
Figure 5:
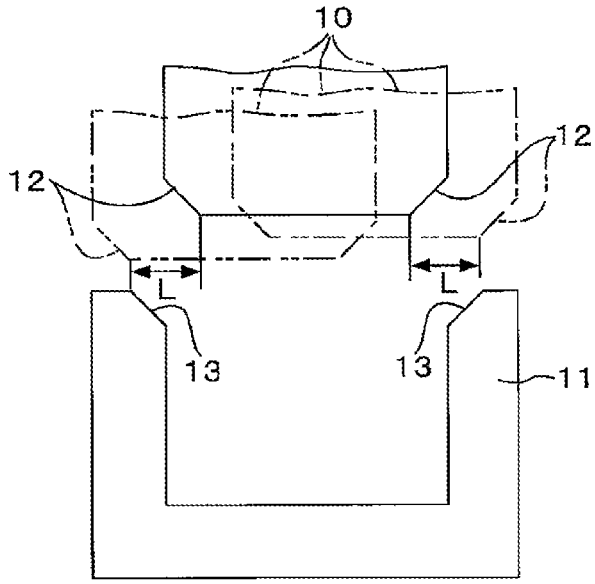
Figure 5 (Prior Art)
FIG. 5 provides an explanatory diagram showing a conventional example in which positional alignment is performed with the tapered face 12 of the electronic device-side connector 10 and the tapered face 13 of the cradle-side connector 11.
Figure 6:
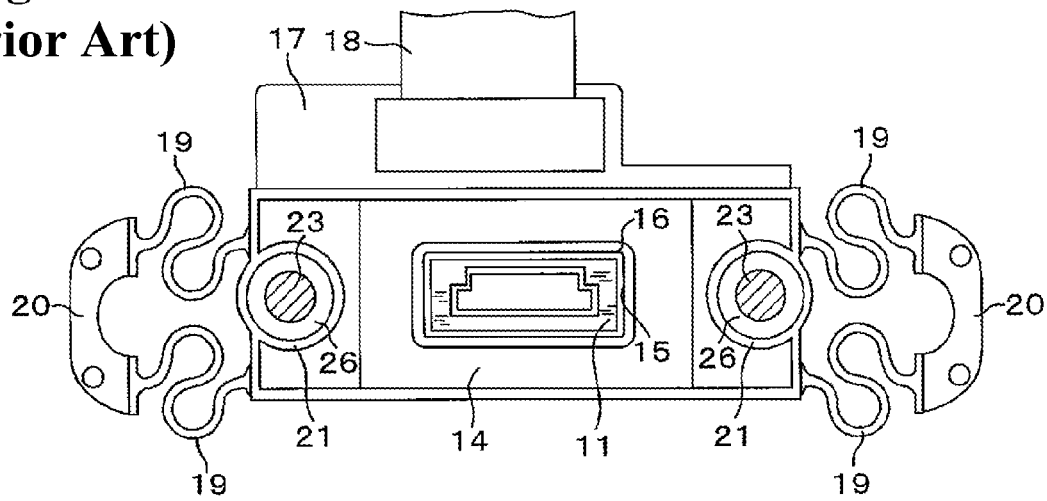
Figure 6 (Prior Art)
FIG. 6 provides a plan view showing a conventional example wherein S-shaped molded elastic parts 19 are formed on the connector housing 14 to form a floating structure.
Figure 7:
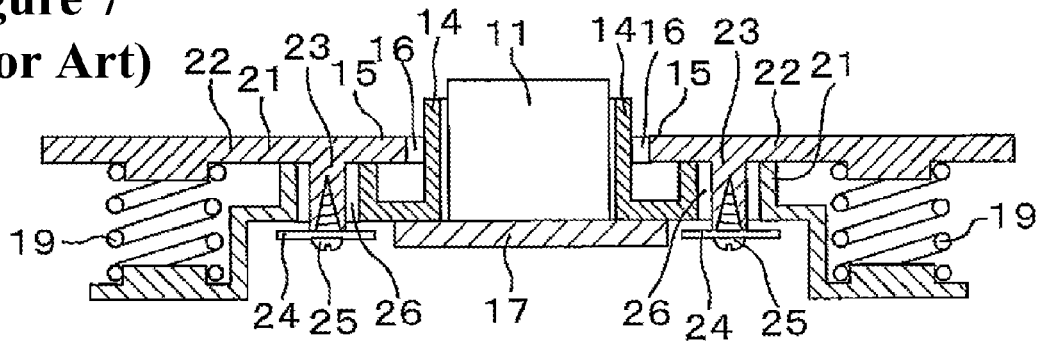
Figure 7 (Prior Art)
FIG. 7 provides a plan view showing a conventional example wherein coil spring elastic members 19 are formed on the connector housing 14 to form a floating structure.

A second embodiment of the present invention is described below with reference to FIGS. 2 to 4.

In this example, for example, an electronic device-side first connector 10*a* having a pin socket 34 for audio transmission-use and a multipole plug 35 for data transmission-use and an electronic device-side second connector 10*b* having a pin plug 32 for power supply-use are disposed a distance apart on the electronic device 27, and also a cradle housing 22 that mates and connects to the electronic device 27 is provided with a cradle-side first connector 11*a* and a cradle-side second connector 11*b*.

In such an example, if the height h1 of the pin plug 32 of the cradle-side first connector 11*a* is greater than the height h2 of the pin socket 34 of the cradle-side second connector 11*b*, since mating of the pin plug 32 of the cradle-side first connector 11*a* with the pin socket 34 of the electronic device-side first connector 10*a* occurs earlier than mating of the pin socket 34 of the cradle-side second connector 11*b* with the pin plug 32 of the electronic device-side first connector 10*b*, it is desired to reduce or set to zero the amount of movement of the cradle-side first connector 11*a*, and to increase the amount of movement of the cradle-side second connector 11*b*.

The operations for mating and connecting the electronic device-side first connector 10*a* and the cradle-side first connector 11*a*, and for mating and connecting the electronic device-side second connector 10*b* and the cradle-side second connector 11*b* are the same as in the first embodiment.

In the above-described embodiments, a flexible elastic material 28 is provided so as to wrap around the entire outer periphery of the connection housing 14 in the cradle-side connector 11, but in the case where movement of the cradle-side connector 11 is not omnidirectional and is restricted in only certain directions, the flexible elastic material 28 may alternatively be provided only in the restricted directions.

It is within the intended scope of the present invention to include all foreseeable equivalents to the elements described herein with reference to FIGS. 1-4. The examples described herein in reference to the several embodiments of the invention are not be interpreted as limiting the invention beyond that which is claimed.

The invention claimed is:

1. A connector assembly having a floating structure, comprising:

a cradle housing; and a connector moveably mounted in the cradle housing, the connector including a portion configured for connecting to and detaching from a coupling connector; wherein:

the cradle housing further comprises a connector-mounting window for receiving an attachment base of the moveably-mounted connector, the moveably-mounted connector is freely moveable within a spacing defined between the connector-mounting window and the attachment base, an elastic member of flexible material is provided on the exterior of a connector housing of the moveably-mounted connector, the elastic member being configured to deform to permit the moveably-mounted connector to move a lateral distance from an uncoupled position to a coupling position for alignment and coupling with the coupling connector, the lateral distance falling within the spacing between the connector-mounting window and the attachment base, the connector housing provided with the elastic member closely contacts and is housed in a housing part formed in the cradle housing, an elastic member restoring force is generated in the elastic member when the moveably-mounted connector and the coupling connector are coupled and the elastic member is deformed, the elastic member restoring force operating when coupling between the moveably-mounted connector and the coupling connector is released to return the attachment base of the moveably-mounted connector to the uncoupled position within the connector-mounting window, on the exterior of the connector housing of the moveably-mounted connector, the elastic member comprises a secondary molding including flexible material that has elasticity, and further comprises a plurality of protrusions on an exterior surface of the secondary molding, and the connector housing is housed such that the protrusions are in close contact with an interior surface of the housing part.

2. The connector having a floating structure cited in claim 1, wherein, on the exterior of the connector housing of the moveably-mounted connector, the elastic member comprises a secondary molding including a flexible material that has elasticity.

3. A connector assembly having a floating structure, comprising:

a cradle housing; and two connectors separated by a certain distance and mounted in the cradle housing; wherein:

at least one of the two connectors is moveably mounted in the cradle housing, the at least one moveably-mounted connectors including a portion configured for connecting to and detaching from a coupling connector, the cradle housing further comprises at least one connector-mounting window for receiving an attachment base of the at least one moveably-mounted connector, the at least one moveably-mounted connector is freely moveable within a spacing defined between the at least one connector-mounting window and the attachment base, an elastic member of flexible material is provided on the exterior of a connector housing of the at least one moveably-mounted connector, the elastic member being configured to deform to permit the moveably-mounted connector to move a lateral distance from an uncoupled position to a coupling position for alignment and coupling with the coupling connector, the lateral distance falling within the spacing between the connector-mounting window and the attachment base, the connector housing provided with the elastic member closely contacts and is housed in a housing part formed in the cradle housing, an elastic member restoring force is generated in the elastic member when the moveably-mounted connector and the coupling connector are coupled and the elastic member is deformed, the elastic member restoring force operating when coupling between the at least one moveably-mounted connector and the coupling connector is released to return the attachment base of the at least one moveable-side connector to the uncoupled position within the at least one connector-mounting window, on the exterior of the connector housing of the at least one moveably-mounted connector, the elastic member comprises a secondary molding including flexible material that has elasticity, and further comprises a plurality of protrusions on an exterior surface of the secondary molding, and the connector housing is housed such that the protrusions are in close contact with an interior surface of the housing part.

4. A connector assembly having a floating structure, comprising:

a cradle housing; and two connectors separated by a certain distance and moveably mounted in the cradle housing, wherein:

the two moveably-mounted connectors each include a portion configured for connecting to and detaching from a respective coupling connector, the cradle housing further comprises two connector-mounting windows each for receiving an attachment base of a respective one of the two moveably-mounted connectors, the two moveably-mounted connectors each being freely moveable within a spacing defined between a respective connector-mounting window and the attachment base of the moveably-mounted connector, an elastic member of flexible material is provided on the exterior of a connector housing for each of the two moveably-mounted connectors, the elastic member being configured to deform to permit the moveably-mounted connector to move a lateral distance from an uncoupled position to a coupling position for alignment and coupling with the coupling connector, the lateral distance falling within the spacing between the connector-mounting window and the attachment base, the connector housing provided with the elastic member for each of the two moveably-mounted connectors closely contacts and is housed in a respective one of two housing parts formed in the cradle housing, an elastic member restoring force is generated in the elastic members for each of the two moveably-mounted connectors when the moveably-mounted connector and the coupling connector are coupled and the elastic member is deformed, the elastic member restoring force operating when coupling between the moveably-mounted connector and the coupling connector is released to return the attachment base of the moveably-mounted connector to the uncoupled position within the respective connector-mounting window, the coupling connectors and the moveably-mounted connectors are configured so that, during coupling, the portion of a first one of the two moveably-mounted connectors is connected to its respective coupling connector before the portion of a second one of the two moveably-mounted connectors is connected to its respective coupling connector, and a moving distance within the spacing defined between the attachment base of the first one of the two moveable-side connectors is set to a smaller value than a moving distance within the spacing defined between the attachment base of the second one of the two moveable-side connectors.

5. A connector for a connector assembly having a floating structure, the connector assembly including a cradle housing having a connector-mounting window and a housing part for receiving the connector, the connector comprising:

a portion configured for connecting to and detaching from a coupling connector;

an attachment base;

a connector housing; and an elastic member of flexible material provided on an exterior surface of the connector housing; wherein:

the attachment base is configured to be received by the connector-mounting window;

the elastic member is configured to closely contact the housing part when the connector housing is housed in the housing part and is configured to deform to permit the moveably-mounted connector to move a lateral distance from an uncoupled position to a coupling position for alignment and coupling with the coupling connector, the lateral distance falling within the spacing between the connector-mounting window and the attachment base, the connector is freely moveable within a spacing defined between the connector-mounting window and the attachment base, and an elastic member restoring force is operable when a coupling between the moveable-side connector and the coupling connector is released to return the attachment base of the moveable-side connector to an uncoupled position within the connector-mounting window, an elastic member restoring force is generated in the elastic member when the connector and the coupling connector are coupled and the elastic member is deformed, the elastic member restoring force operating when coupling between the connector and the coupling connector is released to return the attachment base of the connector to the uncoupled position within the connector-mounting window, on the exterior of the connector housing of the moveably-mounted connector, the elastic member comprises a secondary molding including flexible material that has elasticity, and further comprises a plurality of protrusions on an exterior surface of the secondary molding, and the connector housing is housed such that the protrusions are in close contact with an interior surface of the housing part.

6. A connector assembly having a floating structure, comprising:

a cradle housing; and a connector moveably mounted in the cradle housing, the connector including a portion configured for connecting to and detaching from a coupling connector; wherein:

the cradle housing further comprises a connector-mounting window for receiving an attachment base of the moveably-mounted connector, the moveably-mounted connector is freely moveable within a spacing defined between the connector-mounting window and the attachment base, an elastic member of flexible material is provided on the exterior of a connector housing of the moveable-side connector, the elastic member being configured to deform to permit the moveably-mounted connector to move a lateral distance from an uncoupled position to a coupling position for alignment and coupling with the coupling connector, the lateral distance falling within the spacing between the connector-mounting window and the attachment base, the elastic member comprises a secondary molding including a flexible material that has elasticity, the connector housing provided with the elastic member closely contacts and is housed in a housing part formed in the cradle housing, an elastic member restoring force is generated in the elastic member when the moveably-mounted connector and the coupling connector are coupled and the elastic member is deformed, the elastic member restoring force operating when coupling between the moveable-side connector and the coupling connector is released to return the attachment base of the moveable-side connector to the uncoupled position within the connector-mounting window.

* * * * *